United States Patent [19]

Tetro

[11] 4,422,586

[45] Dec. 27, 1983

[54] METHOD AND APPARATUS FOR ROLL CHANGING

[75] Inventor: Richard S. Tetro, Fulton, N.Y.

[73] Assignee: The Black Clawson Company, Middletown, Ohio

[21] Appl. No.: 325,445

[22] Filed: Nov. 27, 1981

[51] Int. Cl.[3] ..... B65H 19/26; B65H 19/28

[52] U.S. Cl. ..... 242/56 R

[58] Field of Search ..... 242/56 R, 56 A, 64, 242/65, 66, 67.1 R

[56] References Cited

U.S. PATENT DOCUMENTS

| | | | |
|---|---|---|---|
| 3,383,062 | 5/1968 | Meihofer et al. | 242/56 A |
| 3,734,423 | 5/1973 | Kataoka | 242/56 A |
| 3,871,595 | 3/1975 | Smolderen | 242/56 A |
| 3,930,620 | 1/1976 | Taitel | 242/56 A |
| 4,058,267 | 11/1977 | Schüttler | 242/56 A |
| 4,326,679 | 4/1982 | Phelps et al. | 242/56 A |
| 4,326,680 | 4/1982 | Tetro et al. | 242/56 A |
| 4,370,193 | 1/1983 | Knauthe | 242/56 R |

*Primary Examiner*—Stanley N. Gilreath

*Attorney, Agent, or Firm*—Biebel, French & Nauman

[57] ABSTRACT

A cutting blade is mounted on an articulated arm for movement into location adjacent a new core and a free running span of the web on a winding machine. An adhesive strip is applied to the new core and then the core is rotated. A pressure roller on an opposite side of the web from the new core then urges the web into engagement with the surface of the new rotating core. As the adhesive strip rotates into contact with the moving web, it causes the web to be deflected into the knife which results in severing of the web. The leading edge of the severed web is maintained adhered to the adhesive strip so that no fold back of the leading edge occurs as the web continues to wind on the new core.

12 Claims, 10 Drawing Figures

METHOD AND APPARATUS FOR ROLL CHANGING

BACKGROUND OF THE INVENTION

1. Field of the Invention

The field of the invention relates to roll changing apparatus and, more particularly, to means for cutting and transferring a moving web to a new core without stopping the movement of the web.

2. Prior Art

A variety of roll changing apparatus are available in the art for use on both surface winding and center winding machines for the purpose of cutting a continuously moving web and transferring the leading edge of the cut web to a new core. Such devices are illustrated, for example, in U.S. Pat. Nos. 4,058,267; 3,871,595; 3,734,423; and 3,383,062. In each of these devices the cutting blade is driven into the web in order to effect cutting of the web. With modern day winding equipment, however, this manner of cutting the web has become undesirable for several reasons.

The web on modern winding equipment is moving much faster than older equipment, and much of the web material now being wound is more elastic and tends to stretch over the knife blade than was the case with previous materials. As web speeds increase, the speed of the knife as it moves through the web must also increase in order to sever the web at the exact point desired. Failure to sever the web at the right point results in an undesirably long leading edge of web which, when it begins to roll about the new core, often folds back on itself which is undesirable. Likewise, more elastic material is difficult to sever at the exact point desired since it tends to stretch over the knife blade as it is being cut and thus also produces an undesirably long leading edge which folds back on the roll.

One method proposed of overcoming this undesirable fold back produced by most prior art roll changing devices is disclosed in U.S. patent application Ser. No. 165,301, filed July 2, 1980, now U.S. Pat. No. 4,326,679, and assigned to the same Assignee as the present invention. In that device and method the blade is moved into a location adjacent the web and held in a stationary position during the web cutting operation. The web is then moved into the knife blade which produces a cut at the exact point on the web desired so that little or no fold back occurs as the leading edge is transferred to the new core. The present invention is an improvement of that device in that it reduces the necessary parts in the apparatus and provides a somewhat different method of achieving the desirable result of no fold back roll changing.

SUMMARY OF THE INVENTION

The present invention overcomes the above described difficulties and disadvantages associated with prior art devices by providing a means by which a continuously moving web may be severed and transferred to a new core without occasioning fold back of the leading edge being transferred and without interrupting the continuous operation of the winding equipment.

In the present invention an adhesive strip is applied to the outer surface of and extending along the length of a new core upon which a web is to be wound. The core is then positioned adjacent to, but out of engagement with a moving web which is to be transferred to the core. The cutting blade is then brought into a stationary position adjacent both the core and the web, but also out of engagement with the web. The web is then urged into engagement with the core so that the adhesive strip will engage the surface of the web across its width and adhere thereto and cause the web to engage the blade so as to be severed thereby adjacent the adhesive strip while the leading edge of the severed web remains adhered to the adhesive strip to cause the web to be wound on the core.

In a preferred form, a pressure roller is used to urge the web into engagement with the new core. It is normally maintained at a position remote from the surface of the new core and is brought into a ready position just prior to urging the web onto the surface of the new core. The pressure roller is then rapidly moved from the ready position to a transfer position where the web is urged into engagement with the surface of the core.

The cutting blade is preferably mounted on an articulated arm which permits the blade to be moved between its cutting position adjacent the new core and a remote position where the core is free to accumulate web on its surface without interference from the cutting blade or its supporting members.

DETAILED DESCRIPTION OF THE PREFERRED EMBODIMENT

Figure 1:
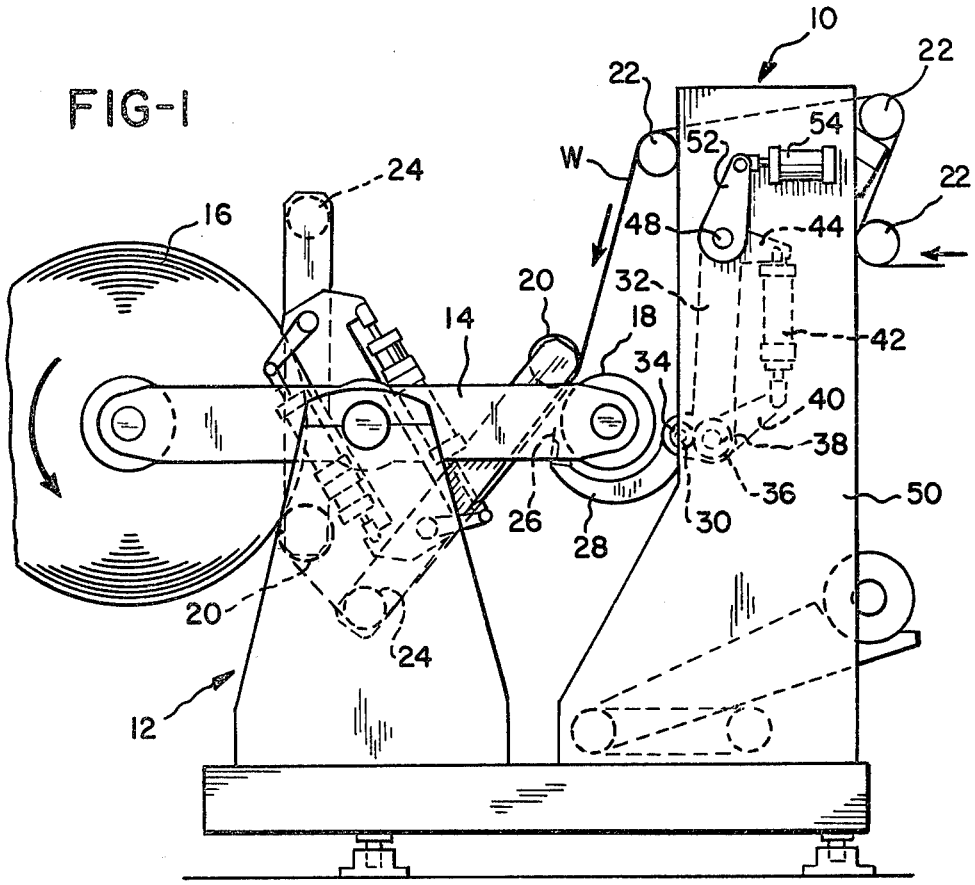
FIG. 1 is a side view of a roll changer apparatus, made in accordance with the present invention, positioned alongside a turret winder for causing a roll change thereon.
Figure 2:
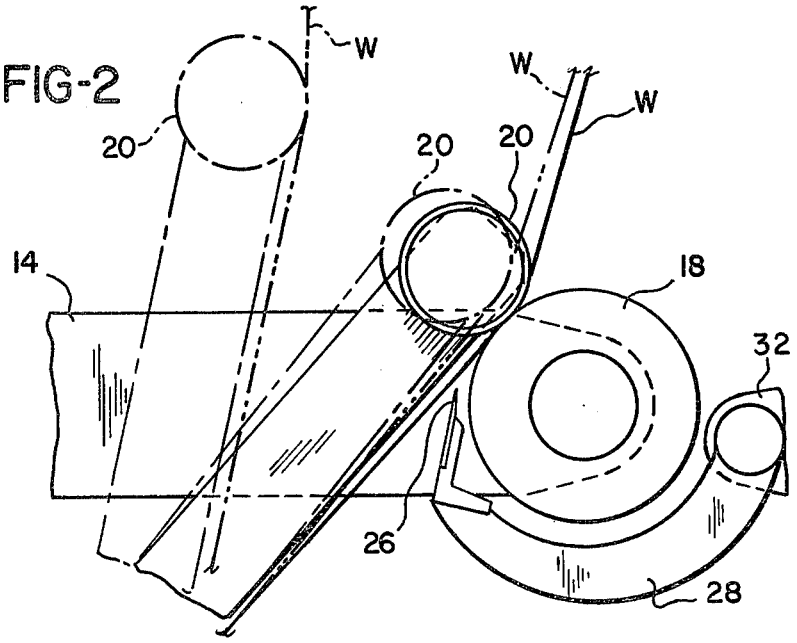
FIG. 2 is an enlargement of a portion of the apparatus of FIG. 1 illustrating the cutting blade adjacent a new core and the web prior to cutting.

As illustrated in FIG. 1, a roll changer 10 constructed in accordance with the present invention is positioned adjacent a turret winder 12 of the type fully disclosed in co-pending application Ser. No. 325,444, filed Nov. 27, 1981 and to which reference should be made for the details of construction thereof. The details of the turret winder 12 are not relevant to the present invention since this invention can be used with many different types of winders, but the device generally consists of a roll support arm 14 which is capable of supporting a roll of wound web material 16 on each end, and is illustrated as having a fully wound roll on one end and a new core 18 on the opposite end on which the web is to be transferred as a result of the operation of the roll changer 10 to be described below. The turret winder 12 also includes pressure rollers 20 about which the moving web W passes and is laid upon the surface of the roll being formed, with the pressure roller 20 maintaining the web in contact with the surface of the roll.

Referring again to the roll changer 10, as illustrated in FIG. 1, it is in position for making a cut and transfer to a new core 18 of the web W. The web W passes through a series of rollers 22 in the upper portion of the roll changer 10 and then passes around the pressure roller 20 to a subsequent auxiliary roller 24. The cut and transfer of the web W will take place adjacent the new core 18 and pressure roller 20. Pressure roller 20, during winding of a roll 16 is normally held at a remote position with respect to the surface of the new core 18. Just prior to making the transfer of the web W to the new core, the pressure roll 20 is moved into a ready position adjacent the core. In the preferred embodiment, although this should not be considered a limitation on the positioning in all situations, it is desirable to place the pressure roller 20 approximately ½ to ¾ of an inch from the surface of the new core, in the ready position. The reason for this is that if the pressure roller is brought down against the new core 18 from a greater distance its speed may cause it to bounce on the new core which is undesirable and may cause a defective transfer of the web. Further, although a pressure roller is utilized as exemplary of means for urging the web into contact with the cutting blade, other forms are contemplated. For example, a brush or air jet could likewise be utilized.

Figure 3:
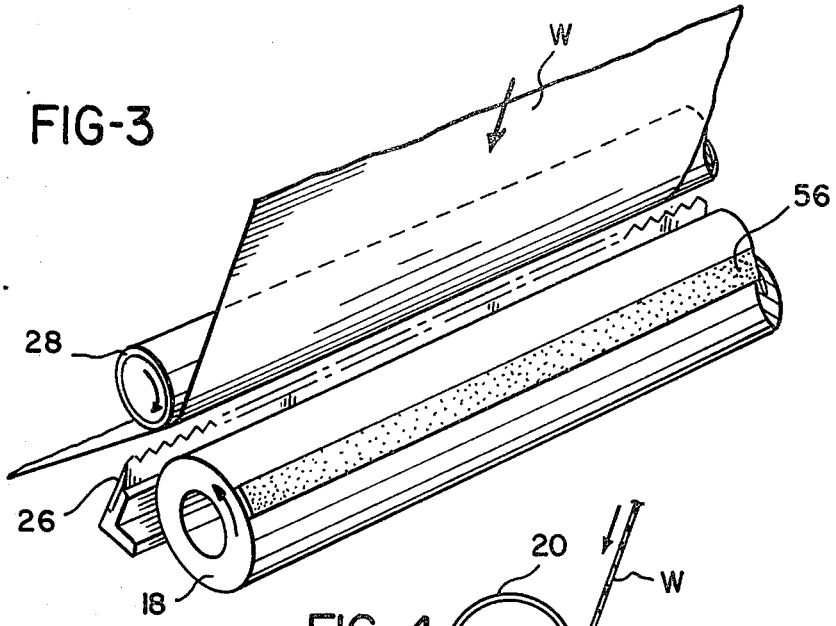
FIG. 3 is a pictorial view of a new core with an adhesive strip applied thereto and positioned adjacent the cutting blade, web, and pressure roller prior to transfer of the web to the new core.

Also prior to making the transfer, the cutting blade 26 is brought into position adjacent the new core 18 and the web W, where it will be held stationary during the making of the cut and transfer to the new core. The blade 26 is preferably serrated as illustrated in FIG. 3 and is supported by a pair of arcuate shaped arms 28 (only one shown) one on each side of the roll changer, and which in turn are fixed to pivot pins 30 supported for rotation at one end of a further pair of arms 32 (only one shown), also disposed one on each side of the roll changer 10. On the outer end of each pivot pin 30 is supported a first gear 34 which is engaged by a second gear 36 supported on pivot shafts 38 (only one shown) mounted for rotation in an end portion each of the arms 32. Secured to shafts 38 are lever arms 40 (only one shown) which in turn are pivotally mounted to the piston rod of double-acting hydraulic cylinder motors 42 (only one shown) which have their opposite ends mounted to extensions 44 of arms 32. Upon activation of hydraulic cylinder motors 42 lever arms 40 are pivoted, causing rotation of gears 36 which in turn causes rotation of gears 34 and pins 30 which in turn produces the pivotal movement of arms 28 to rotate the cutting blade 26 into or out of its cutting position.

Arms 32 are further pivotally mounted at their opposite ends 46 from the end supporting the arms 28, by pivot pins 48 mounted for rotation in side structures 50 of roll changer 10. Further lever arms 52 (only one shown) are secured to pivot pins 48 at one end and have their opposite ends pivotally mounted to further double-acting hydraulic cylinder motors 54 (only one shown) mounted to the side structures 50 of roll changer 10. Activation of hydraulic cylinder motors 54 pivots lever arms 52 causing rotation of pins 48 which in turn causes pivoting of arms 32 to further remove the blade 26 and supporting arms 28 from the region of the new core 18. This additional movement is to provide further room for the expanding roll after the web has been transferred to the new core 18 so that the winding operation is not interferred with by the cutting blade and its supporting structure just described.

The method of operation of the above apparatus can best be described in connection with the sequence of steps illustrated in FIGS. 2 through 10. Looking first at FIG. 2, as previously mentioned, when the transfer of the web W to a new core 18 is not imminent the pressure roller 20 stays in its normal position remote from the surface of the new core 18. Just prior to making the transfer of the web W to the new core 18, the pressure roller 20 is moved into a ready position (shown as the middle position in FIG. 2) removed only slightly from the surface of the new core 18. At the moment transfer is desired, the pressure roller is then moved toward the new core 18 to urge the web W into contact with the surface of the new core.

Figure 4:
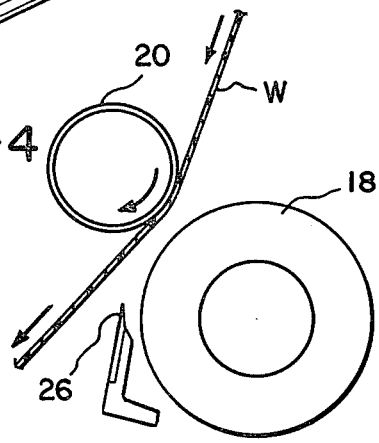
FIG. 4 is a schematic illustration of the cutting blade in position prior to cutting.
Figure 5:
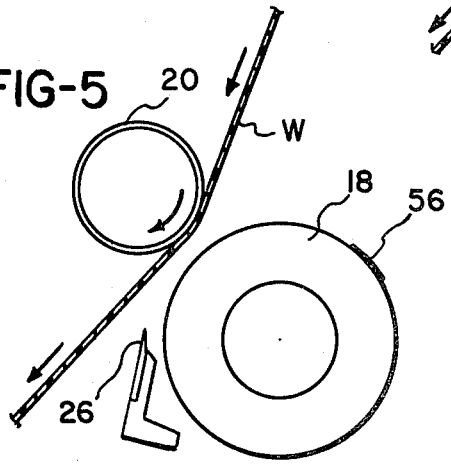
FIG. 5 is a schematic illustration of the adhesive strip having been applied to the new core and the cutting blade in position prior to cutting.

Prior to bringing the pressure roll into the ready position, after the new core has been mounted on the arm 14 of the turret winder 12, as schematically shown in FIG. 4, an adhesive strip 56 is applied to the outer surface of the core 18 and exending substantially along its entire length, while the new core is held in a stationary position. Of course, the adhesive strip 56 could be applied prior to loading the new core 18 into the machine, if desired. It has been found that the width of the adhesive strip is preferably in the range of ¾ to 1½ inches depending upon the material from which the web is made and the adhesive characteristics of the adhesive strip 56. A preferred form of adhesive which is formed to be effective for most web materials is designated series AS veri-strait 8056, available from Minnesota Mining and Manufacturing Company. The thickness of this strip is approximately 1 mm.

Figure 6:
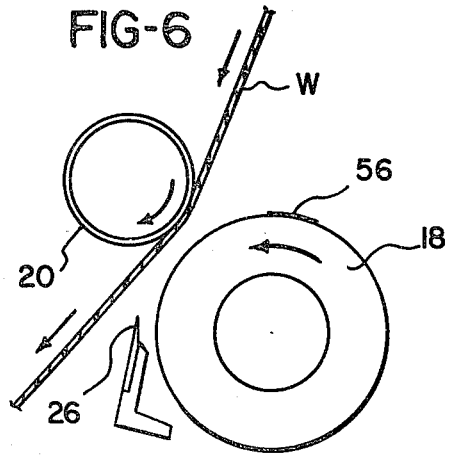
FIG. 6 is a schematic illustration of the new core being rotated and the cutting blade in position prior to cutting.
Figure 7:
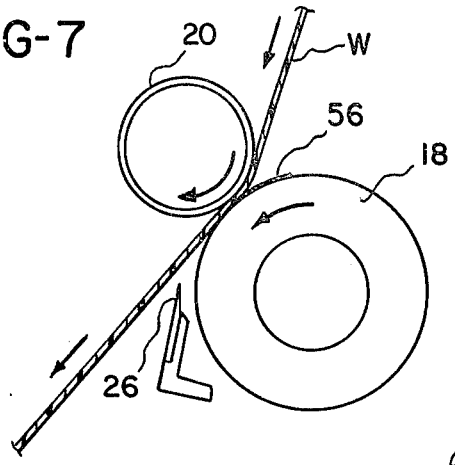
FIG. 7 is a schematic illustration of the web being urged into contact with the new core and the cutting blade in the cutting position.
Figure 8:
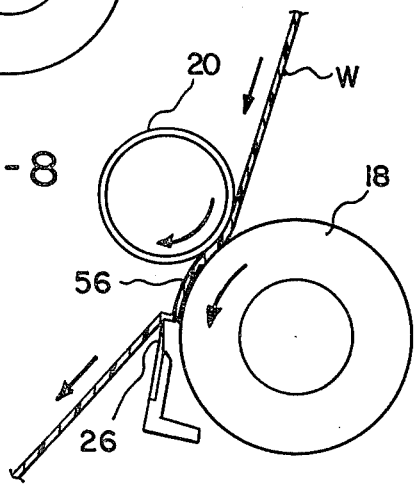
FIG. 8 is a schematic illustration of the web attaching itself to the adhesive strip on the new core and being rotated into contact with the cutting blade.

After the adhesive strip 56 is applied, the new core 18 is rotated as illustrated in FIG. 6. The pressure roller 20 is then moved from the ready position into the transfer position as illustrated in FIG. 7. At this point, adhesive strip 56 as it is rotated into contact with the surface of the web W will adhere to the web and draw the web into the cutting blade 26 as shown in FIG. 8. The web will continue to wrap about the new core 18 causing the web to be severed as it moves across the blade 26.

Figure 9:
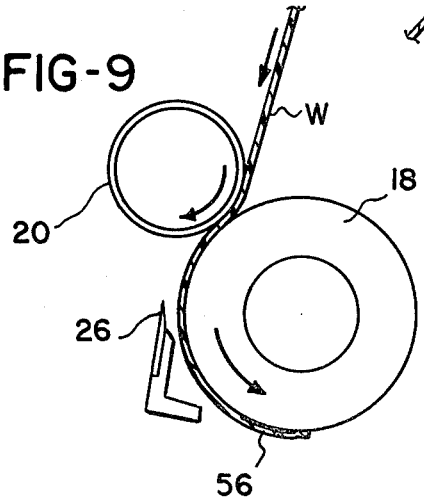
FIG. 9 is a schematic illustration after the web has been severed and attached to the new core and continues to rotate about the new core.
Figure 10:
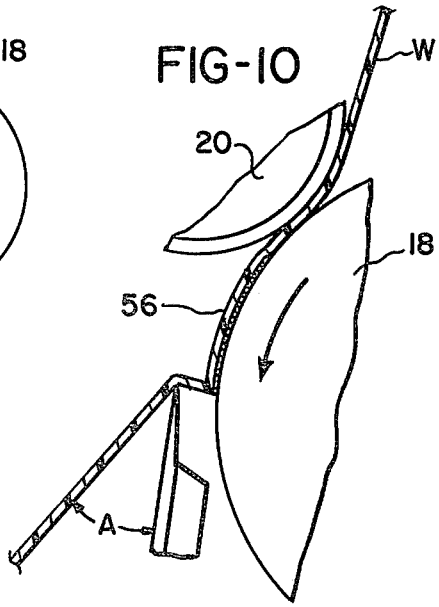
FIG. 10 is a schematic illustration of an enlargement of FIG. 8 showing the manner in which the blade contacts the web as the web is rotated into it.

Since the blade will cut the web at substantially the leading edge of the adhesive strip there will be no opportunity for fold back of the leading edge and it will therefore be maintained against the surface of the new core as it continues to wrap around it, as illustrated in FIG. 9. FIG. 10 shows an enlarged view of FIG. 8 in which the distance from the knife blade 26 to the edge of the adhesive is somewhat exaggerated in order to illustrate the effect of the web being drawn into the knife blade.

Positioning of the knife blade 26 should be such that it minimizes the distance from the cut leading edge of the web to the leading edge of the adhesive strip in order to prevent even a slight amount of loose web which may fold back after cutting. It has been found that the angle A, as illustrated in FIG. 10, between the web and cutting blade 26 can be important for obtaining a proper cut of the web during transfer. The preferred angle for most materials tested is approximately 30°, although it has been found that angles within the range of 30°–60° are effective in cutting many web materials. It is believed that greater or lesser angles than this range could be used on some materials and the angle should therefore not be considered as limited to this range for all materials. Simple tests can be conducted to determine if a given web material can be cut at a desired blade angle.

As mentioned, it is desirable to get the blade as close to the nip formed between the pressure roller and the new core, as possible. In the preferred embodiment, this distance is generally in the range of $\frac{5}{8}$ to $\frac{3}{4}$ of an inch from the nip. However, this distance could be significantly different on other equipment and should not be considered as limiting the present invention but, in any event, should not be permitted to be too great since the web material may not stay maintained adhered to the adhesive strip against the tension on the web caused by the previously wound roll.

It is to be noted that the cut occurs as a result of the tension produced on the outgoing web by the inertia roll 16 and thus tensioning of the web is no problem with this method of making a transfer. Further, this arrangement does not produce a problem with the desired tension on the incoming web which will be transferred to the new core, which in many instances is a relatively low tension that causes significant problems with most prior art web cutting devices, since they must utilize the normal web tension to make the cut.

While the method herein described, and the form of apparatus for carrying this method into effect, constitute preferred embodiments of this invention, it is to be understood that the invention is not limited to this precise method and form of apparatus including an apparatus of more conventional arrangement where the pressure means is outside the arc formed by the indexing core about the axis of the turret, and that changes may be made in either without departing from the scope of the invention, which is defined in the appended claims.

What is claimed is:

1. A method of severing a web being wound on a winding machine, including the steps of:

applying an adhesive strip on the outer surface and extending along the length of a new core upon which web is to be wound;

positioning the new core adjacent but out of engagement with a free running span of the web and rotating said core;

positioning a cutting blade in stationary location adjacent said core and adjacent to but out of engagement with said web downstream of said core; and urging said web into engagement with said rotating core so that said adhesive strip will engage the surface of said web across its width and adhere thereto and cause said web to engage said blade so as to be severed thereby adjacent said adhesive strip while a leading edge of severed web remains adhered to said adhesive strip to cause said web to be wound on said core.

2. A method of severing a web being wound on a winding machine, including the steps of:

applying an adhesive strip on the outer surface and extending along the length of a new core upon which web is to be wound;

positioning the new core adjacent but out of engagement with a free running span of the web and rotating said core;

positioning a cutting blade in stationary location adjacent said core and adjacent to but out of engagement with said web downstream of said core;

urging said web into engagement with said rotating core;

adhering said web to said adhesive strip;

moving said web, by the rotation of said core, into engagement with said blade adjacent a leading edge of said adhesive strip;

severing said web with said blade adjacent said adhesive strip; and maintaining a leading edge of web, formed by severing the web, adhered to said adhesive strip so as to cause said web to wind on said core.

3. A method as defined in claim 1 wherein said step of urging said web into engagement with said core is accomplished by engaging said web with a pressure roller and moving said web, through movement of said pressure roller, into engagement with said core.

4. A method as defined in claim 3 wherein said pressure roller is placed on an opposite side of the web from said core and said cutting blade.

5. A method as defined in claim 3 wherein said web is tensioned during severing by maintaining said web against said core by pressure of said pressure roller to form a nip and applying tension to said web downstream of said nip.

6. A method as defined in claim 5 wherein said steps of positioning a cutting blade adjacent said core and said web includes positioning said cutting blade so that it extends away from said web at an angle in the range of 30° to 60°.

7. A method as defined in claim 1 or 2 wherein said step of positioning a cutting blade adjacent said core and said web includes positioning said cutting blade so that it extends away from said web at an angle of substantially 30°.

8. A method as defined in claim 6 wherein said step of positioning said cutting blade includes positioning it from $\frac{5}{8}$ to $\frac{3}{4}$ inch from said nip.

9. Apparatus for severing a web being wound on a winding machine, comprising:

a core;

an adhesive strip secured to the outer surface of the core along substantially its entire length;

means for supporting and rotating said core adjacent a moving free span of web;

cutting means positionable in a stationary location adjacent to said core, when mounted on said support means, and said web but out of engagement with said web;

means for urging said web into contact with the surface of said rotating core so that said adhesive strip will engage the surface of said web across its width and adhere thereto and cause said web to engage said blade so as to be severed thereby adjacent said adhesive strip while a leading edge of severed web remains adhered to said adhesive strip to cause said web to be wound on said core.

10. Apparatus as defined in claim 9 wherein said urging means is disposed on an opposite side of said web from said core and said cutting means.

11. Apparatus as defined in claim 10 including means supporting said cutting means for movement between a retracted position wherein said cutting means will not interfere with winding of web on a core, and said stationary location for cutting said web.

12. Apparatus as defined in claim 11 wherein said means for urging said web into contact with the surface of the core includes:

a pressure roller;

means supporting said pressure roller for movement between a ready position wherein said roller is in engagement with the web but said web is not in contact with said core, and a transfer position wherein said roller urges said web into contact with said core.

* * * * *